US010011991B2

(12) United States Patent
Thiagarajan et al.

(10) Patent No.: US 10,011,991 B2
(45) Date of Patent: Jul. 3, 2018

(54) MULTIWALL SHEET, METHODS OF MAKING, AND ARTICLES COMPRISING THE MULTIWALL SHEET

(75) Inventors: Chinniah Thiagarajan, Bangalore (IN); Frans Adriaansen, Bergen op Zoom (NL); Michael Matthew Laurin, Pittsfield, MA (US); Bernd Jansen, Bergen op Zoom (NL)

(73) Assignee: SABIC GLOBAL TECHNOLOGIES B.V., Bergen op Zoom (NL)

( * ) Notice: Subject to any disclaimer, the term of this patent is extended or adjusted under 35 U.S.C. 154(b) by 1706 days.

(21) Appl. No.: 13/268,232

(22) Filed: Oct. 7, 2011

(65) Prior Publication Data

US 2013/0089710 A1 Apr. 11, 2013

(51) Int. Cl.
*B32B 3/10* (2006.01)
*E04C 2/54* (2006.01)

(52) U.S. Cl.
CPC ..... *E04C 2/543* (2013.01); *Y10T 29/49826* (2015.01); *Y10T 428/24612* (2015.01)

(58) Field of Classification Search
CPC ..... E04C 2/543
USPC ..... 428/192
See application file for complete search history.

(56) References Cited

U.S. PATENT DOCUMENTS 3,689,024 A 9/1972 Notzel
2002/0155250 A1* 10/2002 Riley ..... 428/99
2007/0251183 A1* 11/2007 Thiagarajan et al. ..... 52/590.1
2010/0287858 A1 11/2010 Israeli et al.
2012/0244359 A1 9/2012 Meyer et al.

FOREIGN PATENT DOCUMENTS

| | | | |
|---|---|---|---|
| CN | 201056790 | | 5/2008 |
| CN | 201056790 | Y | 5/2008 |
| DE | 3604951 | | 8/1987 |
| DE | 3604951 | A1 | 8/1987 |
| DE | 102010005454 | A1 | 7/2010 |
| EP | 0149443 | | 7/1985 |
| EP | 0149443 | A2 | 7/1985 |
| EP | 0572260 | A1 | 12/1993 |

(Continued)

OTHER PUBLICATIONS

International Search Report for International Application No. PCT/US2012/056852, International Application Filing Date Sep. 24, 2012, dated Jan. 4, 2013, 6 pages.

(Continued)

*Primary Examiner* — Christopher Polley
(74) *Attorney, Agent, or Firm* — Cantor Colburn LLP

(57) ABSTRACT

A multiwall sheet comprises a sheet, comprising walls, wherein the walls comprise a first wall; a second wall; and an outermost rib extending between the first wall and the second wall, wherein the first wall extends longitudinally past the outermost rib to a first wall end and wherein the second wall extends longitudinally past the outermost rib to a second wall end; and an end cap comprising a top wall having a top wall end, a bottom wall having a bottom wall end, and a connecting wall disposed between the top wall end and the bottom wall end; wherein the end cap is disposed over the first wall end and the second wall end and wherein the top wall and the bottom wall extend longitudinally along the first wall and the second wall past the outermost rib.

20 Claims, 4 Drawing Sheets

(56) References Cited

FOREIGN PATENT DOCUMENTS

| | | | | |
|---|---|---|---|---|
| EP | 0644305 | A1 | | 3/1995 |
| EP | 1111153 | A2 | | 6/2001 |
| EP | 2369085 | A1 | | 9/2011 |
| GB | 2267298 | A | * | 12/1993 |
| GB | 2412928 | A | | 10/2005 |
| GB | 2474756 | A | | 4/2011 |

OTHER PUBLICATIONS

Written Opinion for International Application No. PCT/US2012/056852, International Application Filing Date Sep. 24, 2012, dated Jan. 4, 2013, 8 pages.

* cited by examiner

MULTIWALL SHEET, METHODS OF MAKING, AND ARTICLES COMPRISING THE MULTIWALL SHEET

TECHNICAL FIELD

The present disclosure relates generally to multiwall sheets, and more particularly to end capped multiwall sheets.

BACKGROUND

In the construction of naturally lit structures (e.g., greenhouses, pool enclosures, solar roof collectors, conservatories, stadiums, sunrooms, and so forth), glass has been employed in many applications as transparent structural elements, such as, windows, facings, and roofs. Glass panels of glass panel roofs can themselves be mounted in frame-like enclosures that are capable of providing a watertight seal around the glass panel and provide a means for securing the panel to a structure. These frame-like enclosures also provide for modular glass roofing systems that can be assembled together to form the roof. However, polymer sheeting is replacing glass in many applications due to several notable benefits.

Glass panel roofing systems generally provide good light transmission and versatility. However, the initial and subsequent costs associated with these systems limit their application and overall market acceptance. The initial expenses associated with glass panel roofing systems comprise the cost of the glass panels themselves as well as the cost of the structure, or structural reinforcements, that are employed to support the high weight of the glass. After these initial expenses, operating costs associated with the inherently poor insulating ability of the glass panels can result in higher heating expenses for the owner. Yet further, glass panels are susceptible to damage caused by impact or shifts in the support structure (e.g., settling), which can result in high maintenance costs. This is especially concerning for horticultural applications wherein profit margins for greenhouses can be substantially impacted due to these expenditures.

Multiwall polymeric panels have been produced that exhibit improved impact resistance, ductility, insulative properties, and comprise less weight than comparatively sized glass panels. As a result, these characteristics reduce operational and maintenance expenses. One benefit of polymer sheeting is that it exhibits excellent impact resistance compared to glass. This in turn reduces breakage and hence, maintenance costs in applications wherein occasional breakage caused by vandalism, hail, contraction/expansion, and so forth, is encountered. Another benefit of polymer sheeting is a significant reduction in weight compared to glass. This makes polymer sheeting easier to install than glass and reduces the load-bearing requirements of the structure on which they are installed. In addition to these benefits, one of the most significant advantages of polymer sheeting is that it provides improved insulative properties compared to glass. This characteristic significantly affects the overall market acceptance of polymer sheeting as consumers desire structural elements with improved efficiency to reduce heating and/or cooling costs.

Multiwall sheets can display high stress around the edges of the multiwall sheet for a given wind load as well as high deflection. Multiwall sheets can also have undesirably low flexural stiffness. Multiwall sheets that possess adequate flexural stiffness, lower stress around the edges, and decreased deflection with a nominal or no increase in weight are desired in the industry.

BRIEF DESCRIPTION

Disclosed, in various embodiments, are multiwall sheets, methods for making the multiwall sheets, and articles comprising the multiwall sheets.

In an embodiment, a multiwall sheet comprises: a sheet, comprising walls, wherein the walls comprise a first wall; a second wall; and an outermost rib extending between the first wall and the second wall, wherein the first wall extends longitudinally past the outermost rib to a first wall end and wherein the second wall extends longitudinally past the outermost rib to a second wall end; and an end cap comprising a top wall having a top wall end, a bottom wall having a bottom wall end, and a connecting wall disposed between the top wall end and the bottom wall end; wherein the end cap is disposed over the first wall end and the second wall end and wherein the top wall and the bottom wall extend longitudinally along the first wall and the second wall past the outermost rib.

In an embodiment, a method of making a multiwall sheet comprises: cutting a sheet to a desired length between two ribs, wherein the sheet comprises walls, wherein the walls comprise a first wall; a second wall; and ribs extending between the first wall and the second wall, wherein the first wall extends longitudinally past an outermost rib to a first wall end and wherein the second wall extends longitudinally past the outermost rib to a second wall end; and attaching an end cap to the sheet by placing the end cap over the first wall end and the second wall end.

BRIEF DESCRIPTION OF THE DRAWINGS

The following is a brief description of the drawings wherein like elements are numbered alike and which are presented for the purposes of illustrating the exemplary embodiments disclosed herein and not for the purposes of limiting the same.

DETAILED DESCRIPTION

Figure 1:
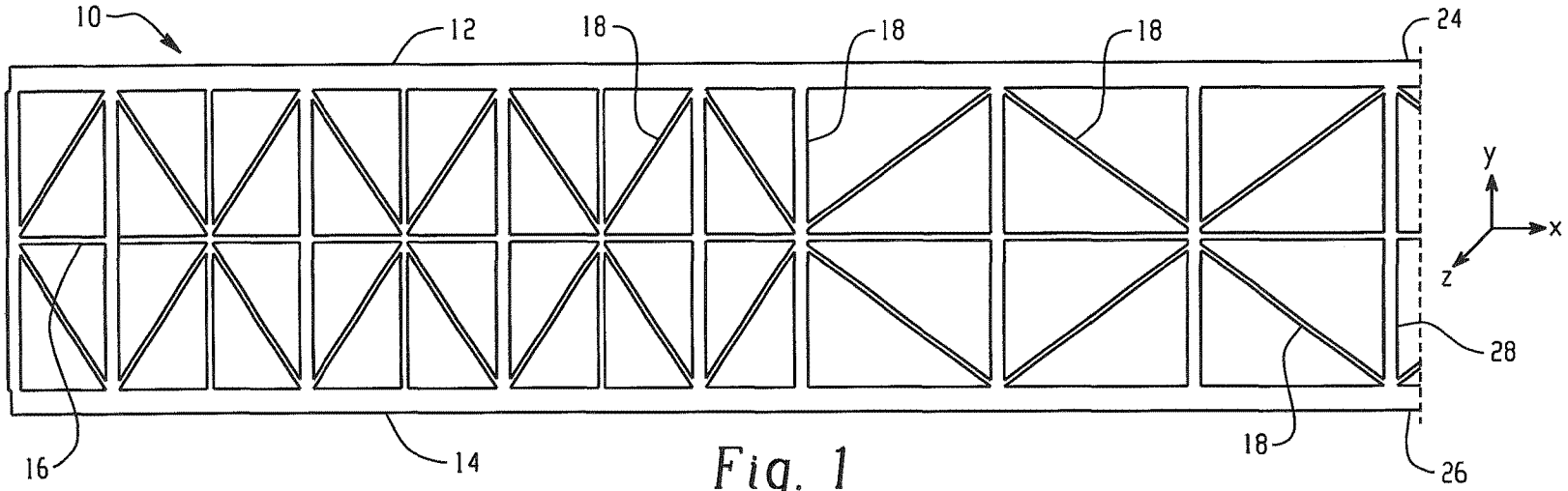
FIG. 1 is a partial, cross-sectional view of a multiwall sheet.

Disclosed herein, in various embodiments, are end capped multiwall sheets. It is desired for multiwall sheets to meet deflection and stress limits for a given wind pressure load and thickness specifications. Multiwall sheets with various configurations of ribs located between the various walls of the multiwall sheets are generally utilized to maximize flexural performance, but the end of the multiwall sheet can be a limiting factor in the overall performance of the multiwall sheet as it can be more prone to break under stress. The sheet can comprise a first wall having a first wall end, a second wall having a second wall end, and an outermost rib extending between the first wall and the second wall. As the sheet is trimmed or cut to a desired size (e.g., length), the first wall end and the second wall end can extend past the outermost rib, leaving the first wall end and the second wall end of the multiwall sheet more susceptible to deflection and breakage, e.g., unsupported.

Multiwall sheets having an end cap as disclosed herein offer improved structural performance and properties since the end cap can provide additional strength and stiffness to the multiwall sheet. For example, multiwall sheets having an end cap as disclosed herein can have reduced deflection and stress properties and a corresponding increase in flexural stiffness as compared to the same multiwall sheet without an end cap. The end cap can comprise a top wall having a top wall end, a bottom wall, having a bottom wall end and a connecting wall disposed between the top wall end and the bottom wall end. The end cap can extend past the outermost rib, or alternatively, past the outermost rib and another rib. Optionally, the connecting wall of the end cap can have a portion removed.

Multiwall sheets with a higher flexural stiffness and lower weight are desired for efficient roof and wall panel applications. Multiwall sheets can have a first wall and a second wall, where the first wall and the second wall are the outermost walls of the multiwall sheet, and/or with optional transverse walls (e.g., horizontal), and/or with optional ribs (e.g., vertical, or non-parallel and non-perpendicular). Multiwall sheets with uniformly dispersed ribs along the span or across the width of the multiwall sheet display a relatively higher stress around the edges for a given wind load as well as a higher deflection and lower flexural stiffness. Additionally, when a multiwall sheet is cut to a specific width, the first wall and the second wall of the multiwall sheet cantilever out from a vertical end rib forming an overhanging section of the multiwall sheet with floating horizontal ribs. A multiwall sheet having such a structure shows a higher stress level and can lack structural integrity when bending forces are applied. A multiwall sheet with the overhanging section can also need increased edge engagement (e.g., longer edge engagement) from profiled attachment systems used to secure the multiwall sheet to a support structure. Exemplary support structures include a beam (e.g., a purlin, I-beam, rectangular beam, etc.), piling, wall, a rafter, post, header, pillar, roof truss, as well as combinations comprising at least one of the foregoing. The first wall and the second wall can be integrated or non-integrated depending on the desired properties of the multiwall sheet. In an embodiment, a rubber gasket can be located between the multiwall sheet and the support structure for water tightness, leakage protection, lowering the contact stress, and for absorbing any thermal expansion between the multiwall sheet and the support structure. The rubber gasket can be any rubber that can provide the desired balance of properties including, but not limited to, neoprene or silicone rubber, as well as combinations comprising at least one of the foregoing.

Higher stress and poor overall performance of the multiwall sheet can limit the application of multiwall sheets in glazing and roofing applications. The properties of the multiwall sheet can be improved with the use of an end cap as disclosed herein located on an end of the multiwall sheet (e.g., wherein the multiwall sheet attaches to a structure or to another multiwall sheet). Multiwall sheets having an end cap can have increased flexural stiffness, decreased deflection, and decreased stress levels as compared to the same structure and material composition multiwall sheet without an end cap. In one embodiment, the end cap can be attached to the multiwall sheet through a variety of methods, including, but not limited to chemical attachment (e.g., adhesive bonding or glue) and/or physical attachment (e.g., ultrasonic welding, vibration welding, laser welding, and so forth), and/or mechanical attachment (e.g., screwed, bolted, riveted, etc.) and/or otherwise affixed to the multiwall sheet. In another embodiment, the end cap can be coextruded with the multiwall sheet to form an integral structure (e.g., formed as part of the multiwall sheet, e.g., as a single, unitary component).

The multiwall sheets disclosed herein can optionally comprise various combinations of ribs (e.g., vertical, diagonal, and any combination thereof) as is desired, e.g., for additional structural integrity. The number of walls (e.g., first, second, transverse, etc.) can additionally vary and be based upon the desired properties for the end use of the multiwall sheet. Any rib, divider, and wall arrangement is based upon the desired structural integrity for the particular multiwall sheet, based upon where the multiwall sheet will be employed and the loads it will experience. Any number of walls can be used, with any combination of support structures being contemplated for use.

The multiwall sheet and the end cap can be formed from a plastic material, such as thermoplastic resins, thermosets, and combinations comprising at least one of the foregoing. Generally, the multiwall sheet and the end cap can be formed from the same plastic material or can be formed from similar plastic materials, so thermal expansion between the multiwall sheet and the end cap is not an issue. The end cap and the multiwall sheet can be in intimate contact (i.e., touching) through the attachment method, so both the end cap and the multiwall sheet expand and/or contract at the same rate. The attachment method as discussed herein can provide intimate contact between the multiwall sheet and the end cap through a chemical bond, a Van der Wals force, or a mechanical bond, leaving no space between the area of attachment on the multiwall sheet and the area of attachment on the end cap.

Possible thermoplastic resins that may be employed to form the multiwall sheet and the end cap include, but are not limited to, oligomers, polymers, ionomers, dendrimers, copolymers such as graft copolymers, block copolymers (e.g., star block copolymers, random copolymers, etc.) and combinations comprising at least one of the foregoing. Examples of such thermoplastic resins include, but are not limited to, polycarbonates (e.g., blends of polycarbonate (such as, polycarbonate-polybutadiene blends, copolyester polycarbonates)), polystyrenes (e.g., copolymers of polycarbonate and styrene, polyphenylene ether-polystyrene blends), polyimides (e.g., polyetherimides), acrylonitrile-styrene-butadiene (ABS), polyalkylmethacrylates (e.g., polymethylmethacrylates (PMMA)), polyesters (e.g., copolyesters, polythioesters), polyolefins (e.g., polypropylenes (PP) and polyethylenes, high density polyethylenes (HDPE), low density polyethylenes (LDPE), linear low density polyethylenes (LLDPE)), polyamides (e.g., polyamideimides), polyarylates, polysulfones (e.g., polyarylsulfones, polysulfonamides), polyphenylene sulfides, polytetrafluoroethylenes, polyethers (e.g., polyether ketones (PEK), polyether etherketones (PEEK), polyethersulfones (PES)), polyacrylics, polyacetals, polybenzoxazoles (e.g., polybenzothiazinophenothiazines, polybenzothiazoles), polyoxadiazoles, polypyrazinoquinoxalines, polypyromellitimides, polyquinoxalines, polybenzimidazoles, polyoxindoles, polyoxoisoindolines (e.g., polydioxoisoindolines), polytriazines, polypyridazines, polypiperazines, polypyridines, polypiperidines, polytriazoles, polypyrazoles, polypyrrolidines, polycarboranes, polyoxabicyclononanes, polydibenzofurans, polyphthalides, polyacetals, polyanhydrides, polyvinyls (e.g., polyvinyl ethers, polyvinyl thioethers, polyvinyl alcohols, polyvinyl ketones, polyvinyl halides, polyvinyl nitriles, polyvinyl esters, polyvinylchlorides), polysulfonates, polysulfides, polyureas, polyphosphazenes, polysilazzanes, polysiloxanes, fluoropolymers (e.g., polyvinyl fluouride (PVF), polyvinylidene fluoride (PVDF), polyvinyl fluoride (PVF), fluorinated ethylene-propylene (FEP), polyethylenetetrafluoroethylene (ETFE)) and combinations comprising at least one of the foregoing.

More particularly, the thermoplastic resin used in the multiwall sheet and for the end cap can include, but is not limited to, polycarbonate resins (e.g., Lexan* resins, commercially available from SABIC Innovative Plastics), polyphenylene ether-polystyrene resins (e.g., Noryl* resins, commercially available from SABIC Innovative Plastics), polyetherimide resins (e.g., Ultem* resins, commercially available from SABIC Innovative Plastics), polybutylene terephthalate-polycarbonate resins (e.g., Xenoy* resins, commercially available from SABIC Innovative Plastics), copolyestercarbonate resins (e.g. Lexan* SLX resins, commercially available from SABIC Innovative Plastics), and combinations comprising at least one of the foregoing resins. Even more particularly, the thermoplastic resins can include, but are not limited to, homopolymers and copolymers of a polycarbonate, a polyester, a polyacrylate, a polyamide, a polyetherimide, a polyphenylene ether, or a combination comprising at least one of the foregoing resins. The polycarbonate can comprise copolymers of polycarbonate (e.g., polycarbonate-polysiloxane, such as polycarbonate-polysiloxane block copolymer), linear polycarbonate, branched polycarbonate, end-capped polycarbonate (e.g., nitrile end-capped polycarbonate), and combinations comprising at least one of the foregoing, for example, a combination of branched and linear polycarbonate.

The multiwall sheet and the end cap can include various additives ordinarily incorporated into polymer compositions of this type, with the proviso that the additive(s) are selected so as to not significantly adversely affect the desired properties of the sheet, in particular, transparency, deflection, stress, and flexural stiffness. Such additives can be mixed at a suitable time during the mixing of the components for forming the multiwall sheet. Exemplary additives include impact modifiers, fillers, reinforcing agents, antioxidants, heat stabilizers, light stabilizers, ultraviolet (UV) light stabilizers, plasticizers, lubricants, mold release agents, antistatic agents, colorants (such as carbon black and organic dyes), surface effect additives, radiation stabilizers (e.g., infrared absorbing), flame retardants, and anti-drip agents. A combination of additives can be used, for example a combination of a heat stabilizer, mold release agent, and ultraviolet light stabilizer. In general, the additives are used in the amounts generally known to be effective. The total amount of additives (other than any impact modifier, filler, or reinforcing agents) is generally 0.001 wt % to 5 wt %, based on the total weight of the composition of the multiwall sheet.

In addition to flexural stiffness, deflection, and lower edge stress, the polymeric material can be chosen to exhibit sufficient impact resistance such that the sheet is capable of resisting breakage (e.g., cracking, fracture, and the like) caused by impact (e.g., hail, birds, stones, and so forth). Therefore, polymers exhibiting an impact strength greater than or equal to about 7.5 foot-pounds per square inch, ft-lb/in$^2$ (4.00 Joules per square centimeter, J/cm$^2$), or more specifically, greater than about 10.0 ft-lb/in$^2$ (5.34 J/cm$^2$) or even more specifically, greater than or equal to about 12.5 ft-lb/in$^2$ (6.67 J/cm$^2$) are desirable, as tested per ASTM D-256-93 (Izod Notched Impact Test). Further, desirably, the polymer has ample stiffness to allow for the production of a sheet that can be employed in applications wherein the sheet is generally supported and/or clamped on two or more sides of the sheet (e.g., clamped on all four sides), such as in greenhouse applications comprising tubular steel frame construction. Sufficient stiffness herein is defined as polymers comprising a Young's modulus (e.g., modulus of elasticity) that is greater than or equal to about $1\times10^9$ (Newtons per square meter (N/m$^2$), more specifically $1\times10^9$ to $20\times10^9$ N/m$^2$, and still more specifically $2\times10^9$ to $10\times10^9$ N/m$^2$.

The total thickness (t) (see FIG. 1, where t is illustrated along the Y axis) of the multiwall sheet is generally less than or equal to 100 millimeters (mm), more specifically, less than or equal to 55 mm, still more specifically, less than or equal to 32 mm, but generally greater than or equal to 6 mm. In one embodiment, the multiwall sheet has a thickness of 16 mm. In another embodiment, the multiwall sheet has a thickness of 10 mm, specifically 20 mm.

The multiwall sheet can comprise a width (w) (see FIG. 1, where w is illustrated along the X axis) capable of providing sufficient spatial area coverage for the intended use (e.g., as a roofing, sheeting, or similar products). For example, the width of the multiwall sheet can generally be less than or equal to 2 meters (m), more specifically, less than or equal to 1.8 m, still more specifically, less than or equal to 1.25 m, yet more specifically, less than or equal to 1.2 m (4 feet), even more specifically, less than or equal to 0.9 m (3 feet), even more specifically still, less than or equal to 0.6 m (2 feet), but generally greater than or equal to 400 mm. In one embodiment, the multiwall sheet has a width of 1 m.

The multiwall sheet can comprise a length (l) (see FIG. 1, where l is illustrated along the Z axis) capable of providing sufficient stiffness for the intended use (e.g., as a roofing, sheeting product, or similar product). For example, the length of the multiwall sheet can generally be greater than or equal to 100 mm, more specifically, greater than or equal to 1 m, still more specifically, greater than or equal to 1.5 m, but generally greater than or equal to 6 m. When assembled, the multiwall sheet can be exposed to a variety of forces caused by snow, wind, rain, hail, and the like. The sheet is desirably capable of withstanding these forces without failing (e.g., buckling, cracking, bowing, and so forth). The specific dimensions of the multiwall sheet can be chosen so that the multiwall sheet can withstand these forces.

The end cap comprising a top wall having a top wall end, a bottom wall having a bottom wall end, and a connecting wall disposed between the top wall end and the bottom wall end, can have a thickness of greater than or equal to 0.25 mm, specifically, greater than or equal to 0.75 mm, more specifically, greater than or equal to 1 mm. In an embodiment, the thickness of the end cap can be less than or equal to two times the thickness of the first wall and the second wall of the multiwall sheet. The thickness of the end cap refers to the thickness of each wall of the end cap including the top wall, the bottom wall, and the connecting wall.

The multiwall sheet can be transparent, depending upon the desired end use. For example, multiwall sheet can have a transparency of greater than or equal to 80%, specifically, greater than or equal to 85%, more specifically, greater than or equal to 90%, even more specifically, greater than or equal to 95%, and still more specifically, greater than or equal to 99%. The end cap can also be transparent as described with respect to the multiwall sheet, or can be translucent, or can be opaque. For example, a translucent end cap can have a transparency of greater than or equal to 50%, specifically, greater than or equal to 65%, and more specifically, greater than or equal to 75%. The end cap can be designed so that it is not visible once attached to the multiwall sheet (e.g., the end cap can be attached to purlins or other support structures of the multiwall sheet). In such a case, the end cap can be translucent or opaque, since it will not interfere with the overall transparency of the multiwall sheet.

Transparency is described by two parameters, percent transmission and percent haze. Percent transmission and percent haze for laboratory scale samples can be determined using ASTM D1003-00, procedure B using CIE standard illuminant C. ASTM D-1003-00 (Procedure B, Spectrophotometer, using illuminant C with diffuse illumination with unidirectional viewing) defines transmittance as:

$$\% T = \left(\frac{I}{I_O}\right) \times 100\% \quad (1)$$

wherein: I=intensity of the light passing through the test sample $I_o$=Intensity of incident light.

A multiwall sheet can be formed from various polymer processing methods, such as extrusion or injection molding, if produced as a unitary structure. Continuous production methods, such as extrusion, generally offer improved operating efficiencies and greater production rates than non-continuous operations, such as injection molding. Specifically, a single screw extruder can be employed to extrude a polymer melt (e.g., polycarbonate, such as Lexan*, commercially available from SABIC Innovative Plastics). The polymer melt is fed to a profile die capable of forming an extrudate having the cross-section of the multiwall sheet 10 illustrated in FIG. 1. The multiwall sheet 10 travels through a sizing apparatus (e.g., vacuum bath comprising sizing dies) and is then cooled below its glass transition temperature (e.g., for polycarbonate, about 297° F. (147° C.)).

After the panel has cooled, it can be cut to the desired length utilizing, for example, an extrusion cutter such as an indexing in-line saw. Once cut, the multiwall sheet can be subjected to secondary operations before packaging. Exemplary secondary operations can comprise annealing, printing, attachment of fastening members, trimming, further assembly operations, and/or any other desirable processes. The size of the extruder, as measured by the diameter of the extruder's screw, is based upon the production rate desired and calculated from the volumetric production rate of the extruder and the cross-sectional area of the panel. The cooling apparatus can be sized (e.g., length) to remove heat from the extrudate in an expedious manner without imparting haze.

Haze can be imparted when a polymer (e.g., polycarbonate) is cooled rapidly. Therefore, the cooling apparatus can operate at warmer temperatures (e.g., greater than or equal to about 100° F. (39° C.), or more specifically, greater than or equal to 125° F. (52° C.), rather than colder temperatures (e.g., less than 100° F. (39° C.), or more specifically, less than or equal to about 75° F. (24° C.)) to reduce hazing. If warmer temperatures are employed, the bath length can be increased to allow ample time to reduce the extrudate's temperature below its glass transition temperature. The size of the extruder, cooling capacity of the cooling apparatus, and cutting operation can be capable of producing the multiwall sheet at a rate of greater than or equal to about 5 feet per minute. However, production rates of greater than about 10 feet per minute, or even greater than about 15 feet per minute can be achieved if such rates are capable of producing surface features that comprise the desired attributes.

Coextrusion methods can also be employed for the production of the multiwall sheet. Coextrusion can be employed to supply different polymers to any portion of the multiwall sheet's geometry to improve and/or alter the performance of the sheet and/or to reduce raw material costs. One skilled in the art would readily understand the versatility of the process and the myriad of applications in which coextrusion can be employed in the production of multiwall sheets.

A more complete understanding of the components, processes, and apparatuses disclosed herein can be obtained by reference to the accompanying drawings. These figures (also referred to herein as "FIG.") are merely schematic representations based on convenience and the ease of demonstrating the present disclosure, and are, therefore, not intended to indicate relative size and dimensions of the devices or components thereof and/or to define or limit the scope of the exemplary embodiments. Although specific terms are used in the following description for the sake of clarity, these terms are intended to refer only to the particular structure of the embodiments selected for illustration in the drawings, and are not intended to define or limit the scope of the disclosure. In the drawings and the following description below, it is to be understood that like numeric designations refer to components of like function.

FIG. 1 illustrates a multiwall sheet 10 comprising walls, where the walls include a first wall 12, a second wall 14, a transverse wall 16, and a rib 18 extending between the first wall 12 and the second wall 14, the first wall 12 and the transverse wall 16, and/or the transverse wall 16 and the second wall 14. In other words, the rib 18 can extend between any two adjacent walls. The first wall 12 and the second wall 14 are the outermost walls of the multiwall sheet 10. In one embodiment, the transverse wall 16 can extend longitudinally the length of the first wall 12 and the second wall 14. In another embodiment, the transverse wall 16 can be parallel to the first wall 12 and the second wall 14 or, the transverse wall 16 can be substantially parallel to the first wall 12 and the second wall 14 (e.g., not completely parallel across the entire length of the first wall 12 and the second wall 14, but also not intersecting the first wall 12 or the second wall 14, accommodating for slight variations in the orientation during processing). The first wall 12 has a first wall end 24 and the second wall 14 has a second wall end 26. Ribs 18 can be attached to one wall of the multiwall sheet 10 (see e.g., FIG. 3), and/or can be attached to any two walls of the multiwall sheet 10 (see e.g., FIGS. 1 and 4), and/or can be floating in the various layers of the multiwall sheet 10 (e.g., not attached to any walls of the multiwall sheet 10).

For example, floating ribs that are not attached for the first wall 12 or the second wall 14 can provide air pockets that increase thermal insulation properties (e.g., the floating ribs can break the thermal conduction path which can increase the thermal insulation properties) and can also act to increase the shading coefficient of the multiwall sheet. Shading coefficient is the ratio of solar gain passing through a glass unit to the solar energy that passes through a 3 mm thick piece of glass and generally gives an indication of how the multiwall sheet is thermally insulating (i.e., shading) the interior when there is direct sunlight on the multiwall sheet. The ribs 18 can be any shape that will provide the desired properties for the multiwall sheet (e.g., stiffness and/or structural integrity), for example, linear or curved. The multiwall sheet 10 can also comprise an outermost rib 28 disposed between the first wall end 24 and the second wall end 26.

The first wall 12 can extend longitudinally past the outermost rib 28 to the first wall end 24 and the second wall 14 can extend longitudinally past the outermost rib 28 to the second wall end 26. For example, the first wall end 24 and the second wall end 26 can extend greater than or equal to 3 mm past the outermost rib 28, specifically, greater than or equal to 5 mm, more specifically, greater than or equal to 7.5 mm, even more specifically, greater than or equal to 10 mm, still more specifically, greater than or equal to 20 mm, and still more specifically, greater than or equal to 25 mm.

Figure 2:
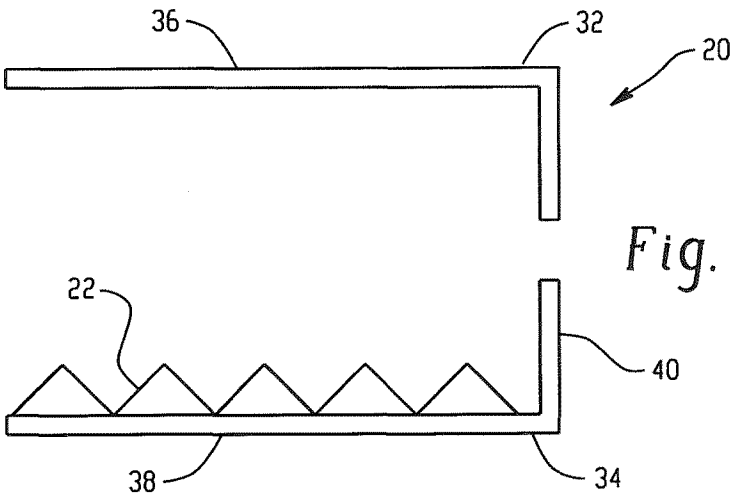
FIG. 2 is a cross-sectional view of an end cap.

FIG. 2 illustrates an end cap 20. The end cap 20 comprises a top wall 36 having a top wall end 32, a bottom wall 38 having a bottom wall end 34, and a connecting wall 40. The connecting wall 40 can be disposed between the top wall end 32 and the bottom wall end 34, such that the end cap 20 forms a "C" shape. Alternatively, the connecting wall 40 can also be disposed between the top wall 36 and the bottom wall 38, such that the end cap forms an "H" shape (e.g., the connecting wall 40 can be disposed at the halfway point of the top wall 36 and the bottom wall 38). The top wall 36 and the bottom wall 38 can extend longitudinally along the first wall 12 and the second wall 14 of the multiwall sheet 10 past the outermost rib 28. For example, when the end cap 20 is attached to the multiwall sheet 10, the top wall 36 and the bottom wall 38 of the end cap 20 can extend 1 mm to 50 mm past the outermost rib 28, specifically 2.5 mm to 25 mm, more specifically, 5 mm to 10 mm past the outermost rib 28. The top wall 36 and the bottom wall 38 of the end cap 20 can extend greater than or equal to 2.5 mm past the outermost rib 28, specifically, greater than or equal to 5 mm, more specifically, greater than or equal to 10 mm, even more specifically, greater than or equal to 15 mm, still more specifically, greater than or equal to 20 mm, and still more specifically, greater than or equal to 25 mm past the outermost rib 28.

The end cap 20 can, optionally, additionally comprise energy directors 22 on any or all surfaces (see e.g., FIG. 2 where energy directors 22 are present on the bottom wall 38). The energy directors 22 can also be configured to engage an outer surface of the multiwall sheet 10 (e.g., the first wall 12 or the second wall 14) to which the end cap 20 will be attached. The energy directors 22 can aid in grasping and retaining the multiwall sheet 10 and/or can redirect energy received by the multiwall sheet 10 e.g., during welding (e.g., ultrasonic and/or thermal welding) together of the multiwall sheet 10 and the end cap 20.

In an embodiment, the connecting wall 40 can, optionally, be modified to remove part of the connecting wall 40 as illustrated in FIG. 2 at the midpoint so that if the end cap 20 is attached to a connector (e.g., a standing seam connector), the full length of the top wall 36 and the bottom wall 38 can be evenly loaded during attachment (e.g., welding, providing increased and consistent weld strength). The connecting wall 40 can become too stiff to flex during the attachment process giving low weld strengths of 0 to greater than 100 pounds per linear inch on the same multiwall sheet. If a portion of the connecting wall 40 is removed as illustrated in FIG. 2, weld strengths of over 200 pounds per square inch can be observed on the same multiwall sheet.

Using multiple energy directors 22 can be advantageous because it can increase the odds of having an energy director 22 over a rib 18 in a multiwall sheet 10. The number of energy directors 22 employed can be different on each horizontal surface (i.e., top wall 36 and bottom wall 38), and optionally the vertical surface (i.e., connecting wall 40), and can vary depending on the length of the horizontal surfaces and the amount of ribs 18. For example, greater than or equal to 2 energy directors can be generally employed on each horizontal surface, specifically, greater than or equal to 4, more specifically, greater than or equal to 5, and yet more specifically, greater than or equal to 8. Although any geometry can be employed for the energy director 22, a generally triangular geometry is employed, e.g., a right triangle extending into receiving area. The height of the energy director 22 can vary. Generally the height is less than or equal to 2 mm (millimeters), specifically, 0.25 mm to 2 mm, more specifically, 0.5 to 1 mm. In an embodiment, the energy directors have a height of 0.7 mm.

The energy directors 22 can be formed as an integral part of the end cap 20. Furthermore, to enhance compatibility between the multiwall sheet 10 and the end cap 20, the end cap 20 and energy directors 22 can be formed from the same type of material as the multiwall sheet 10, or can be a composition comprising the same type of material as the multiwall sheet 10. For example if the multiwall sheet 10 is made from polycarbonate, the end cap 20 and the energy director 22 can be polycarbonate, or a composition comprising polycarbonate, such as a polycarbonate and ABS.

Not to be limited by theory, it is believed that the energy directors pinpoint the energy of the vibrating ultrasonic horn to a small area between the end cap 20 and the multiwall sheet 10, causing the energy director 22 to melt and subsequently fuse to the multiwall sheet 10 with a strong chemical and physical bond made from the melted material. Without the energy directors 22, the ultrasonic horn would vibrate, heat, and compress a large unmelted end cap 20 into the multiwall sheet 10, crushing the multiwall sheet 10 or creating a very weak bond. In addition to or as an alterative to welding, the end cap 20 can be attached to the multiwall sheet 10 by other chemical and/or mechanical methods (e.g., gluing, chemical bonding, fastener(s), and combinations comprising at least one of the foregoing).

Figure 3:
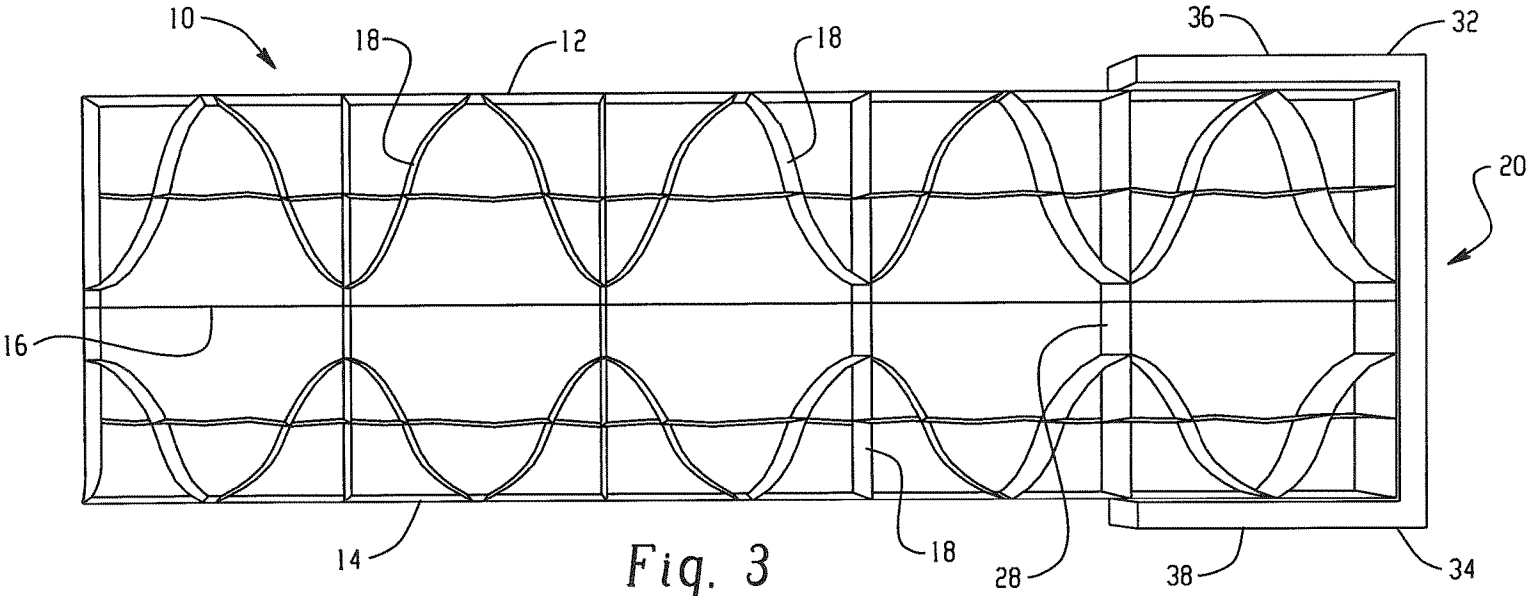
FIG. 3 is a partial, cross-sectional view of a multiwall sheet having an end cap attached thereto.

FIG. 3 illustrates a multiwall sheet 10 with an end cap 20 disposed on the first wall end 24 and the second wall end 26 of the multiwall sheet 10. As with the multiwall sheet 10 illustrated in FIG. 1, in an embodiment, a transverse wall 16 can optionally be present and if present, can extend longitudinally along the length of the first wall 12 and the second wall 14. In another embodiment, the transverse wall 16 can be parallel to the first wall 12 and the second wall 14 or, the transverse wall 16 can be substantially parallel to the first wall 12 and the second wall 14 (e.g., not completely parallel across the entire length of the first wall 12 and the second wall 14, but also not intersecting the first wall 12 or the second wall 14, accommodating for slight variations in the orientation during processing).

As illustrated in FIG. 3, the end cap 20 can extend longitudinally partially along a length of the multiwall sheet (e.g., extends partially along the length of the first wall 12 and the second wall 14). As illustrated in FIG. 3, the top wall 36 and the bottom wall 38 can extend to the outermost rib 28. As a force is applied to the multiwall sheet 10 (e.g., wind pressure loading), the end cap 20 can provide additional stiffness and structural integrity to the multiwall sheet 10 to increase flexural stiffness of the multiwall sheet 10, decrease deflection, and decrease stress of the multiwall sheet 10.

Figure 4:
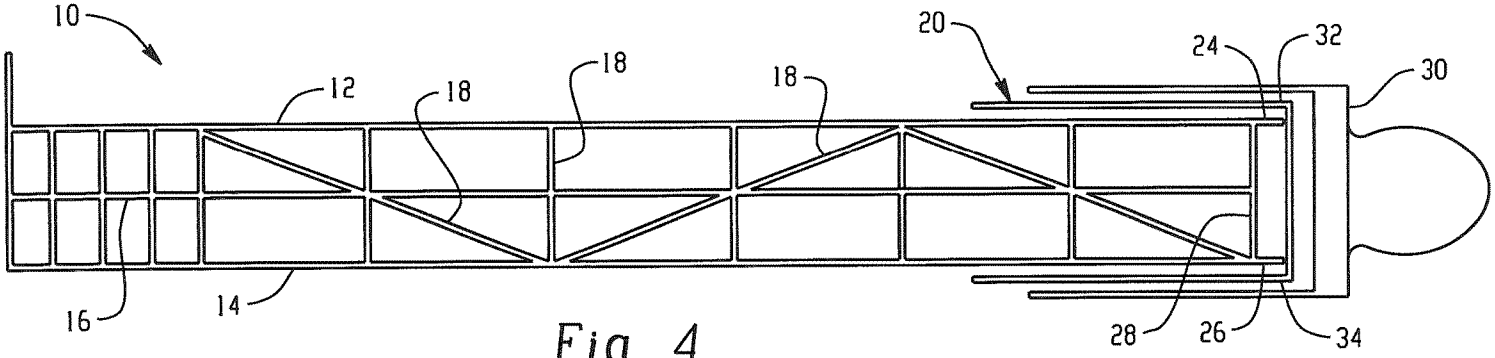
FIG. 4 is a partial, cross-sectional view of a multiwall sheet having an end cap and a connector attached thereto.

FIG. 4 illustrates a similar multiwall sheet 10 also comprising walls, where the walls include a first wall 12, a second wall 14, a transverse wall 16, and a rib 18 adjacent the walls. As with the multilayer sheet 10 illustrated in FIG. 1, in an embodiment, the transverse wall 16, when preset, can extend longitudinally along the length of the first wall 12 and the second wall 14. In another embodiment, the transverse wall 16 can be parallel to the first wall 12 and the second wall 14 or, the transverse wall 16 can be substantially parallel to the first wall 12 and the second wall 14 (e.g., not completely parallel across the entire length of the first wall 12 and the second wall 14, but also not intersecting the first wall 12 or the second wall 14, accommodating for slight variations in the orientation during processing). In the embodiment illustrated in FIG. 4, an end cap 20 is disposed over the first wall end 24 and the second wall end 26 past the outermost rib 28 and past another rib 18. Optionally, as is illustrated in FIG. 4, a connector 30 (e.g., a standing seam connector or a click connector) can be disposed over the end cap 20 for attachment to a structure as herein described (e.g., ultrasonic welding, laser welding, adhesive bonding, etc.) or for attachment to another multiwall sheet. If ultrasonically welded, the end cap 20 can have energy directors 22 disposed on the surfaces of the end cap 20 that will contact the connector 30.

The multiwall sheet is further illustrated by the following non-limiting examples. All of the following examples were based upon simulations unless specifically stated otherwise.

EXAMPLES

Example 1

A sheet having an end cap is compared to the same structure and material composition sheet (e.g., same length, width, thickness, and material composition) without an end cap. Table 1 lists the sheet specifications and the testing parameters. Comparative Sample 1 (C1) and Sample 1 each comprise a 32 mm thick, 5 wall sheet. The edge engagement for the tests is 20 mm, (i.e., the sheet is supported for a width of 20 mm on all four sides of the sheet). The sheet length is greater than 3 m. The end cap in Sample 1 is 50 mm long (e.g., extends 50 mm along the length of the multiwall sheet) and is 1.2 mm thick. The samples are tested across a 1,000 mm span (i.e., width) of the multiwall sheet. The multiwall sheets as tested comprise polycarbonate and the end caps comprise polycarbonate. A load is applied to the sheet and the deflection and, stress, are measured to determine the flexural properties. Deflection is measured in the middle of the sheet and is measured in millimeters (mm), while stress is measured in mega-Pascals (MPa), and comparative flexural stiffness is measured in Newtons per cubic meter ($N/m^3$) according to the slope of the wind load versus the sheet deflection.

Tests are conducted using industry standard numerical simulation software. Table 1 illustrates the material data for the polycarbonate used in the simulations as the material for the multiwall sheets and for the end cap. The Young's Modulus value (E) for polycarbonate (e.g., Lexan*) is 2,400 MPa and the Poisson's ratio (Nu) value is 0.38.

TABLE 1

| Sample No. | Structure of Multiwall Sheet | Load ($N/m^2$)* | Deflection (mm) | Stress (MPa)** | Comparative Flexural Stiffness ($N/m^3$) |
|---|---|---|---|---|---|
| C1 | no end cap | 2,112 | 51.21 | 74.85 | 47,797 |
| 1 | end cap | 2,112 | 37.57 | 47.82 | 58,108 |
| Improvement compared to C1 | | | 27% reduction | 36% reduction | 22% increase |

*Load = wind pressure loading
**= Young's Modulus

TABLE 2

| Polycarbonate Material Properties | | | |
|---|---|---|---|
| Property | Test Method | Unit | Value* |
| Thermal Conductivity | DIN 52612 | W/m° C. | 0.21 |
| CTE | VDE 030411 | m/m° C. | $7 \times 10^{-5}$ |
| Specific Gravity | DIN 53479 | $g/cm^3$ | 1.20 |
| Tensile strength @ yield | DIN 53455 | $N/mm^2$ | 60 |
| Tensile Modulus | DIN 53457 | $N/mm^2$ | 2300 |

*Value measured on injection molded laboratory sample

Figure 5:
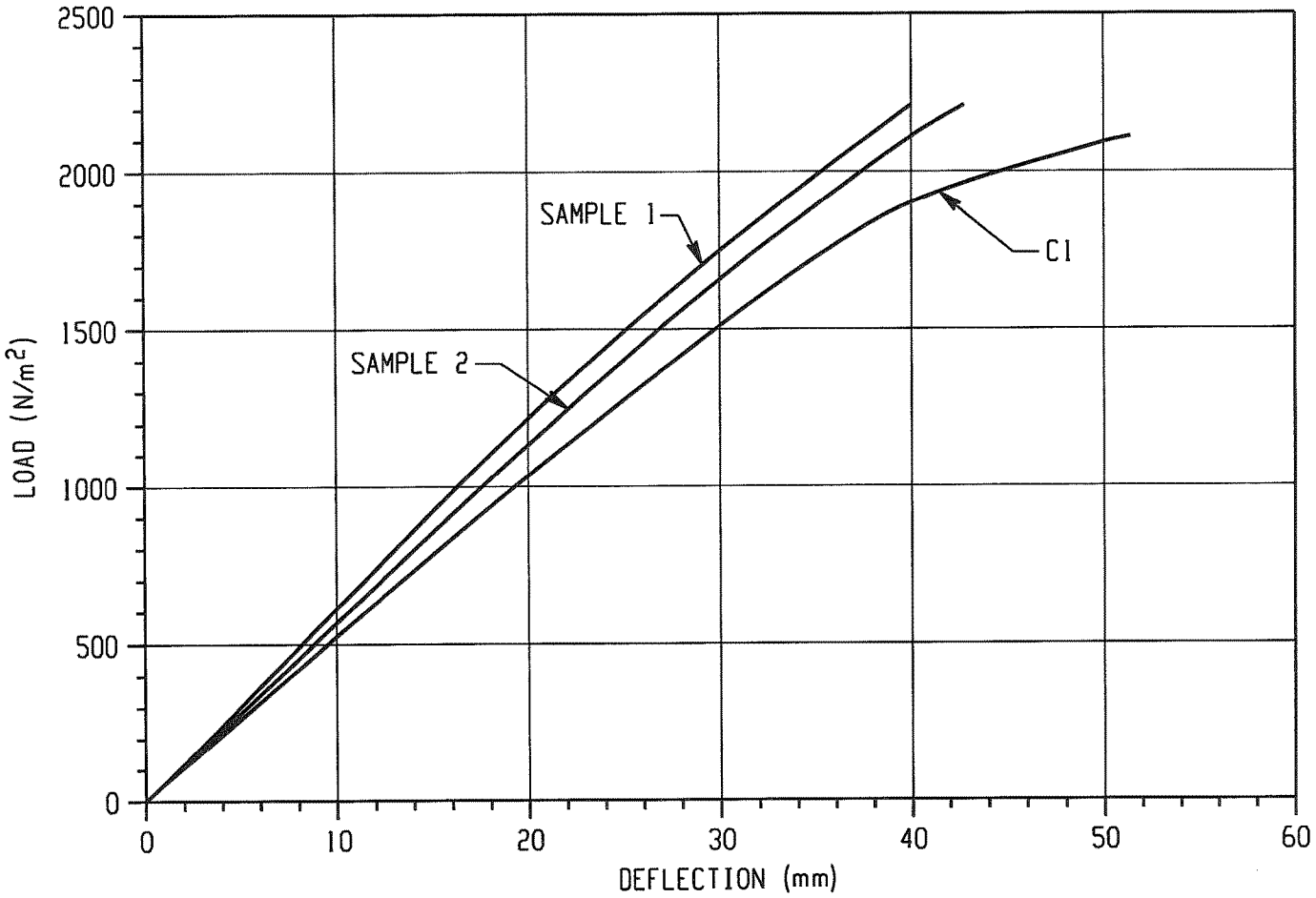
FIG. 5 is a graphical representation of the load versus deflection of a sheet without an end cap as compared to a sheet having an end cap extending 50 millimeters (mm) along the length of the sheet and a sheet having an end cap extending 20 mm along the width of the sheet.

As can be seen in Table 1, sheets having an end cap as herein described have an overall improvement in deflection, stress, and flexural stiffness properties as compared to the same sheet without an end cap. These results are graphically illustrated in FIG. 5, which shows the load versus deflection for Sample 1, C1, and Sample 2. As illustrated in FIG. 5, as the load increases, the deflection is less for both Sample 1 (Table 1) and Sample 2 (Table 3) and continues to increase for C1. For example, the multiwall sheets described herein can have a greater than or equal to a 20% reduction in deflection, specifically, greater than or equal to a 25% reduction in deflection, more specifically, greater than or equal to a 27% reduction in deflection, and even more specifically, greater than or equal to a 30% reduction in deflection. The multiwall sheets can also have a 25% reduction in stress, specifically, a 30% reduction in stress, more specifically, a 35% reduction in stress, even more specifically, a 36% reduction in stress, and more specifically still, a 40% reduction in stress. The multiwall sheets described herein can also have a 15% increase in flexural stiffness, specifically, a 20% increase in flexural stiffness, more specifically, a 22% increase in flexural stiffness, and even more specifically, a 25% increase in flexural stiffness.

The multiwall sheets disclosed herein can have both deflection and equivalent stress reduction of greater than or equal to 25%. This is significant, because, generally, if deflection is decreased, the flexural stiffness is increased and the stress is also increased. With the use of the end caps as disclosed herein, the deflection and stress can be simultaneously decreased while the flexural stiffness can be increased.

Example 2

In this example, a sheet with an end cap is compared to the same sheet without an end cap. Sample 2 comprises a 32 mm thick, 5 wall sheet. C1 is as described above in Example 1. The edge engagement for the tests is 20 mm. The end cap in Sample 2 is 20 mm long (e.g., extends 20 mm along the length of the multiwall sheet) and is 2 mm thick. The samples are tested across a 1,000 mm span of the multiwall sheet. The multiwall sheets as tested comprise polycarbonate and the end caps comprise polycarbonate as described in Table 2. A load is applied to the sheet and the deflection and stress are measured to determine the flexural properties. Deflection and stress are measured as described above in Example 1. Table 3 illustrates the results obtained from each test for Sample 2 and C1.

TABLE 3

| Sample No. | Structure of Multiwall Sheet | Load ($N/m^2$)* | Deflection (mm) | Stress (MPa)** | Comparative Flexural Stiffness ($N/m^3$) |
|---|---|---|---|---|---|
| C1 | no end cap | 2,112 | 51.21 | 74.85 | 47,797 |
| 2 | end cap | 2,112 | 40.30 | 49.03 | 54,175 |
| Improvement compared to C1 | | | 21% reduction | 34% reduction | 13% increase |

*Load = wind pressure loading
**= Young's Modulus

Table 3 demonstrates that even with a shorter end cap as compared to Sample 1, the deflection and stress of the sheet still decrease and the flexural stiffness still increases. A shorter end cap may be desired for aesthetic reasons. For example, the end cap of Sample 2 can be hidden inside the support structure. As illustrated in Table 3, Sample 2 has a 21% decrease in deflection, a 34% decrease in stress, and a 13% increase in flexural stiffness as compared to the same sheet without an end cap.

Example 3

In this example, a sheet with an end cap is compared to the same sheet (e.g., same length, width, thickness, and material) without an end cap. Table 4 lists the sheet specifications and the testing parameters. Comparative Sample 2 (C2) and Sample 3 each comprise a 32 mm thick, 5 wall sheet. The edge engagement for the tests is 50 mm. The end cap in Sample 3 is 100 mm long (e.g., extends 100 mm along the length of the multiwall sheet) and is 1.2 mm thick. The samples are tested across a 1,500 mm span of the multiwall sheet. The multiwall sheets as tested comprise polycarbonate and the end caps comprise polycarbonate. Deflection and stress are measured as described above in Example 1 to determine the flexural properties. Table 4 illustrates the results obtained from each test for Sample 3 and C2.

TABLE 4

| Sample No. | Structure of Multiwall Sheet | Load ($N/m^2$)* | Deflection (mm) | Stress (MPa)** | Flexural Stiffness ($N/m^3$) |
|---|---|---|---|---|---|
| C2 | no end cap | 2,112 | 80.82 | 75.20 | 16,258 |
| 3 | end cap | 2,112 | 56.83 | 62.87 | 21,570 |
| Improvement compared to C2 | | | 30% reduction | 16% reduction | 31% increase |

*Load = wind pressure loading
**= Young's Modulus

Figure 6:
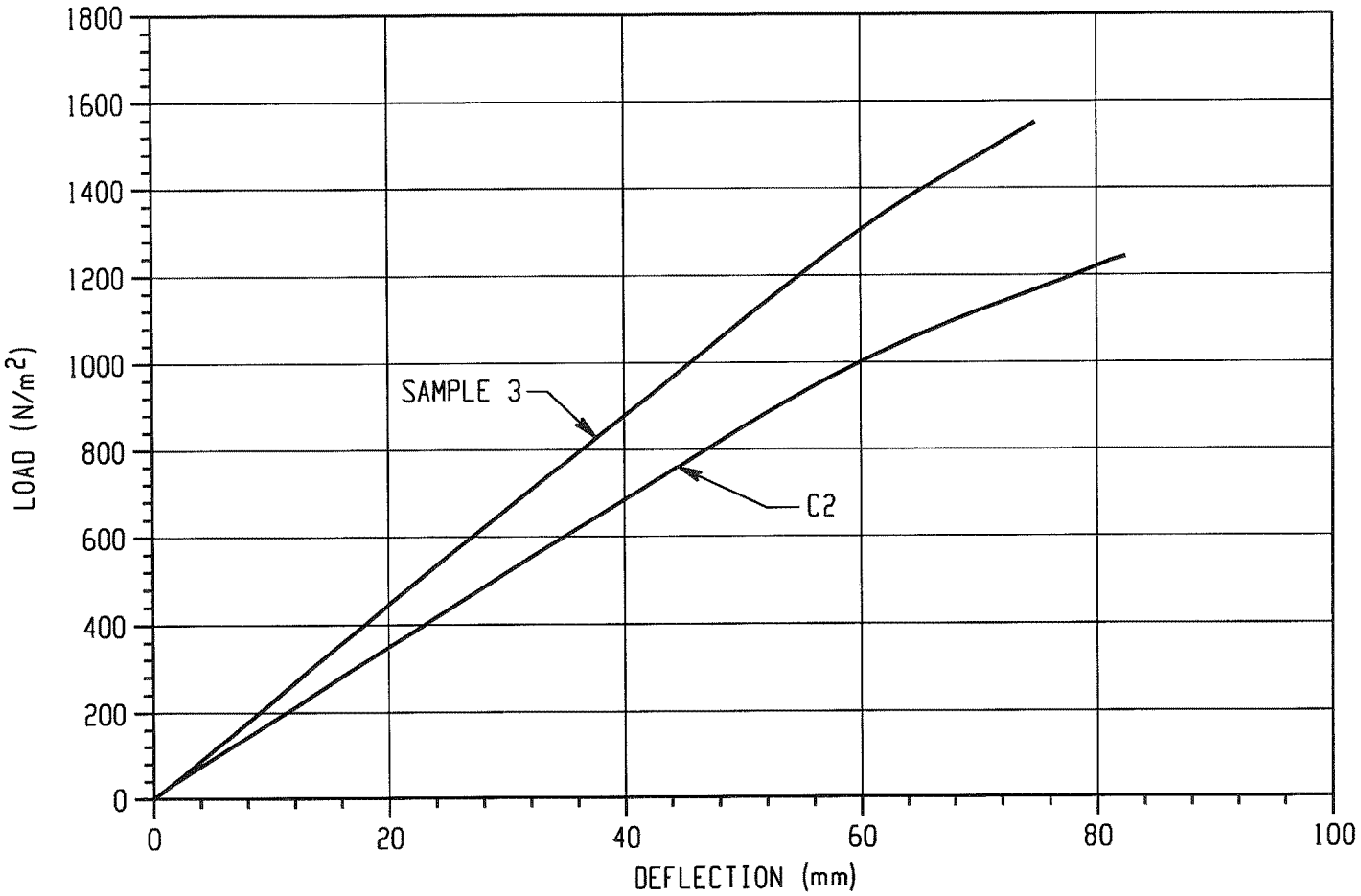
FIG. 6 is a graphical representation of the load versus deflection of a sheet having an end cap versus a sheet without an end cap as tested across a 1,500 meter (m) span of the sheet.

Table 4 illustrates that the sheets disclosed herein can have a decrease in deflection, a decrease in stress, and an increase in flexural stiffness with an end cap. For example, Sample 3 has a 30% reduction in deflection, a 16% reduction in stress and a 31% increase in flexural stiffness as compared to the same multiwall sheet without an end cap. In this example, the span is increased to 1,500 as compared to 1,000 mm in Samples 1 and 2. Generally, as the span increases, the deflection increases. Sample 3 demonstrates that the end cap is beneficial to the larger span multiwall sheet also. These results are illustrated in FIG. 6, where it is shown that as the load increases, the deflection is much less for Sample 3, which has a end cap, as compared to C2.

Multiwall sheets having an end cap as disclosed herein are capable of having increased flexural stiffness, reduced deflection, and reduced stress as compared to the same multiwall sheet without an end cap. The end cap can be attached to the multiwall sheet with the use of cold bending, ultrasonic welding, and/or adhesive bonding to provide a stiff multiwall sheet. A coextruded end capped multiwall sheet is also possible as described herein. An end cap having a top wall and a bottom wall with a length as small as 20 mm can provide the desired deflection, stress, and stiffness properties. The multiwall sheets disclosed herein can be used in industrial applications, and in building and construction applications, such as stadiums, greenhouses, solar tower glazing, walls, roofs, and so forth.

In one embodiment, a multiwall sheet comprises: a sheet, comprising walls, wherein the walls comprise a first wall; a second wall; and an outermost rib extending between the first wall and the second wall, wherein the first wall extends longitudinally past the outermost rib to a first wall end and wherein the second wall extends longitudinally past the outermost rib to a second wall end; and an end cap comprising a top wall having a top wall end, a bottom wall having a bottom wall end, and a connecting wall disposed between the top wall end and the bottom wall end; wherein the end cap is disposed over the first wall end and the second wall end and wherein the top wall and the bottom wall extend longitudinally along the first wall and the second wall past the outermost rib.

In another embodiment, a method of making a multiwall sheet comprises: cutting a sheet to a desired length between two ribs, wherein the sheet comprises walls, wherein the walls comprise a first wall; a second wall; and ribs extending between the first wall and the second wall, wherein the first wall extends longitudinally past an outermost rib to a first wall end and wherein the second wall extends longitudinally past the outermost rib to a second wall end; and attaching an end cap to the sheet by placing the end cap over the first wall end and the second wall end.

In the various embodiments: (i) the end cap comprises a plastic material; and/or (ii) the end cap is attached to the sheet by a method selected from the group consisting of adhesive bonding, ultrasonic welding, laser welding, vibration welding, and combinations comprising at least one of the foregoing; and/or (iii) the first wall end and the second wall end extend greater than or equal to 3 mm past the outermost rib; and/or (iv) the end cap extends greater than or equal to 5 mm past the outermost rib; and/or (v) the top wall and the bottom wall extend past another rib; and/or (vi) the top wall, the bottom wall, the connecting wall each have a thickness of greater than or equal to 1 millimeter; and/or (vii) the multiwall sheet further comprises a connector disposed over the end cap; and/or (viii) the sheet has a greater than or equal to 20% increase in flexural stiffness across a 1,000 meter span compared to the same structure and material composition sheet without the end cap; and/or (ix) the sheet has a greater than or equal to 25% reduction in deflection across a 1,000 meter span compared to the same structure and material composition sheet without the end cap; and/or (x) the sheet has a greater than or equal to 25% reduction in stress across a 1,000 meter span compared to the same structure and material composition sheet without the end cap; and/or (xi) an article comprises the multiwall sheet; and/or (xii) the method further comprises extruding the sheet; and/or (xiv) the sheet has a greater than or equal to 20% increase in flexural stiffness across a 1,000 meter span compared to the same structure and material composition sheet without the end cap, a greater than or equal to 25% reduction in deflection across a 1,000 meter span compared to the same structure and material composition sheet without the end cap, and a greater than or equal to 25% reduction in stress across a 1,000 meter span compared to the same structure and material composition sheet without the end cap.

All ranges disclosed herein are inclusive of the endpoints, and the endpoints are independently combinable with each other (e.g., ranges of "up to 25 wt. %, or, more specifically, 5 wt. % to 20 wt. %", is inclusive of the endpoints and all intermediate values of the ranges of "5 wt. % to 25 wt. %," etc.). "Combination" is inclusive of blends, mixtures, alloys, reaction products, and the like. Furthermore, the terms "first," "second," and the like, herein do not denote any order, quantity, or importance, but rather are used to denote one element from another. The terms "a" and "an" and "the" herein do not denote a limitation of quantity, and are to be construed to cover both the singular and the plural, unless otherwise indicated herein or clearly contradicted by context. The suffix "(s)" as used herein is intended to include both the singular and the plural of the term that it modifies, thereby including one or more of that term (e.g., the film(s) includes one or more films). Reference throughout the specification to "one embodiment", "another embodiment", "an embodiment", and so forth, means that a particular element (e.g., feature, structure, and/or characteristic) described in connection with the embodiment is included in at least one embodiment described herein, and may or may not be present in other embodiments. In addition, it is to be understood that the described elements may be combined in any suitable manner in the various embodiments.

While particular embodiments have been described, alternatives, modifications, variations, improvements, and substantial equivalents that are or may be presently unforeseen may arise to applicants or others skilled in the art. Accordingly, the appended claims as filed and as they may be amended are intended to embrace all such alternatives, modifications variations, improvements, and substantial equivalents.

What is claimed is:

1. A multiwall sheet, comprising:

a sheet, comprising walls, wherein the walls comprise:

a first wall;

a second wall; and an outermost rib extending between the first wall and the second wall, wherein the first wall extends longitudinally past the outermost rib to a first wall end and wherein the second wall extends longitudinally past the outermost rib to a second wall end; and an end cap comprising a top wall having a top wall end, a bottom wall having a bottom wall end, and a connecting wall disposed between the top wall end and the bottom wall end;

wherein the end cap is disposed over the first wall end and the second wall end and wherein the top wall and the bottom wall extend longitudinally along the first wall and the second wall past the outermost rib.

2. The multiwall sheet of claim 1, wherein the end cap comprises a plastic material.

3. The multiwall sheet of claim 1, wherein the end cap is attached to the sheet by a method selected from the group consisting of adhesive bonding, ultrasonic welding, laser welding, vibration welding, and combinations comprising at least one of the foregoing.

4. The multiwall sheet of claim 1, wherein the first wall end and the second wall end extend greater than or equal to 3 mm past the outermost rib.

5. The multiwall sheet of claim 1, wherein the end cap extends greater than or equal to 5 mm past the outermost rib.

6. The multiwall sheet of claim 1, wherein the top wall and the bottom wall extend past another rib.

7. The multiwall sheet of claim 1, wherein the top wall, the bottom wall, the connecting wall each have a thickness of greater than or equal to 1 millimeter.

8. The multiwall sheet of claim 1, further comprising a connector disposed over the end cap.

9. The multiwall sheet of claim 1, wherein the sheet has a greater than or equal to 20% increase in flexural stiffness across a 1,000 meter span compared to the same structure and material composition sheet without the end cap.

10. The multiwall sheet of claim 1, wherein the sheet has a greater than or equal to 25% reduction in deflection across a 1,000 meter span compared to the same structure and material composition sheet without the end cap.

11. The multiwall sheet of claim 1, wherein the sheet has a greater than or equal to 25% reduction in stress across a 1,000 meter span compared to the same structure and material composition sheet without the end cap.

12. An article comprising the multiwall sheet of claim 1.

13. The multiwall sheet of claim 1, wherein the end cap further comprises energy directors on a surface of the multiwall sheet.

14. The multiwall sheet of claim 1, wherein part of the connecting wall of the end cap is removed.

15. A method of making a multiwall sheet, comprising:

cutting a sheet to a desired length between two ribs, wherein the sheet comprises walls, wherein the walls comprise a first wall;

a second wall; and ribs extending between the first wall and the second wall, wherein the first wall extends longitudinally past an outermost rib to a first wall end and wherein the second wall extends longitudinally past the outermost rib to a second wall end; and attaching an end cap to the sheet by placing the end cap over the first wall end and the second wall end.

16. The method of claim 15, further comprising extruding the sheet.

17. The method of claim 15, wherein attaching the end cap to the sheet comprises a method selected from the group consisting of adhesive bonding, ultrasonic welding, laser welding, vibration welding, and combinations comprising at least one of the foregoing.

18. The method of claim 15, wherein the first wall end and the second wall end extend greater than or equal to 3 mm past the outermost rib.

19. The method of claim 15, further comprising attaching a connector over the end cap.

20. The method of claim 15, wherein the sheet has a greater than or equal to 20% increase in flexural stiffness across a 1,000 meter span compared to the same structure and material composition sheet without the end cap, a greater than or equal to 25% reduction in deflection across a 1,000 meter span compared to the same structure and material composition sheet without the end cap, and a greater than or equal to 25% reduction in stress across a 1,000 meter span compared to the same structure and material composition sheet without the end cap.

* * * * *